US009350095B2

(12) United States Patent
Arichika et al.

(10) Patent No.: US 9,350,095 B2
(45) Date of Patent: May 24, 2016

(54) CONNECTOR

(71) Applicant: Molex, LLC, Lisle, IL (US)

(72) Inventors: Kenta Arichika, Yamato (JP); Toshiyuki Someya, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/567,556

(22) Filed: Dec. 11, 2014

(65) Prior Publication Data

US 2015/0263464 A1 Sep. 17, 2015

(30) Foreign Application Priority Data

Dec. 12, 2013 (JP) ..... 2013-256578

(51) Int. Cl.
*H01R 13/627* (2006.01)
*H01R 12/70* (2011.01)
*H01R 12/71* (2011.01)

(52) U.S. Cl.
CPC ..... *H01R 12/7029* (2013.01); *H01R 13/6271* (2013.01); *H01R 12/7052* (2013.01); *H01R 12/716* (2013.01)

(58) Field of Classification Search
CPC ..... H01R 9/096; H01R 12/57; H01R 13/639; H01R 13/6275; H01R 12/52; H01R 12/716; H01R 13/6271; H01R 13/6272
USPC ..... 439/374, 65, 74, 353, 357, 660
See application file for complete search history.

(56) References Cited

U.S. PATENT DOCUMENTS

| | | | | |
|---|---|---|---|---|
| 7,207,842 | B1 | 4/2007 | Kenjo | |
| 7,585,185 | B2 * | 9/2009 | Obikane | H01R 13/65802 439/108 |
| 8,292,635 | B2 * | 10/2012 | Little | H01R 12/7029 439/570 |
| 8,408,931 | B2 | 4/2013 | Sato et al. | |
| 8,992,234 | B2 * | 3/2015 | Yoshioka | H01R 12/716 439/74 |
| 9,147,969 | B2 | 9/2015 | Takenaga et al. | |
| 2007/0010110 | A1 * | 1/2007 | Ono | H01R 12/67 439/74 |
| 2013/0012039 | A1 * | 1/2013 | Nose | H01R 12/716 439/74 |
| 2013/0280926 | A1 * | 10/2013 | Ono | H01R 12/7052 439/65 |

* cited by examiner

*Primary Examiner* — Neil Abrams
*Assistant Examiner* — Travis Chambers
(74) *Attorney, Agent, or Firm* — James A. O'Malley

(57) ABSTRACT

The Present Disclosure is a connector comprising a connector main body, terminals mounted in the connector main body, and a reinforcing main fitting mounted in the connector main body. The connector main body includes a mating guide portion formed on both longitudinal ends, the mating guide portion mating with an opposing mating guide portion formed on both longitudinal ends of the opposing connector main body of an opposing connector. The reinforcing metal fitting includes a pair of left and right contact arm portions, and a pair of left and right side guide portions disposed in the mating guide portions. The side guide portions guide the opposing mating guide portions, and the contact arm portions establishing contact with the opposing reinforcing metal fitting mounted in the opposing connector main body when the connector main body is mated with the opposing connector main body.

20 Claims, 7 Drawing Sheets

FIG. 3A
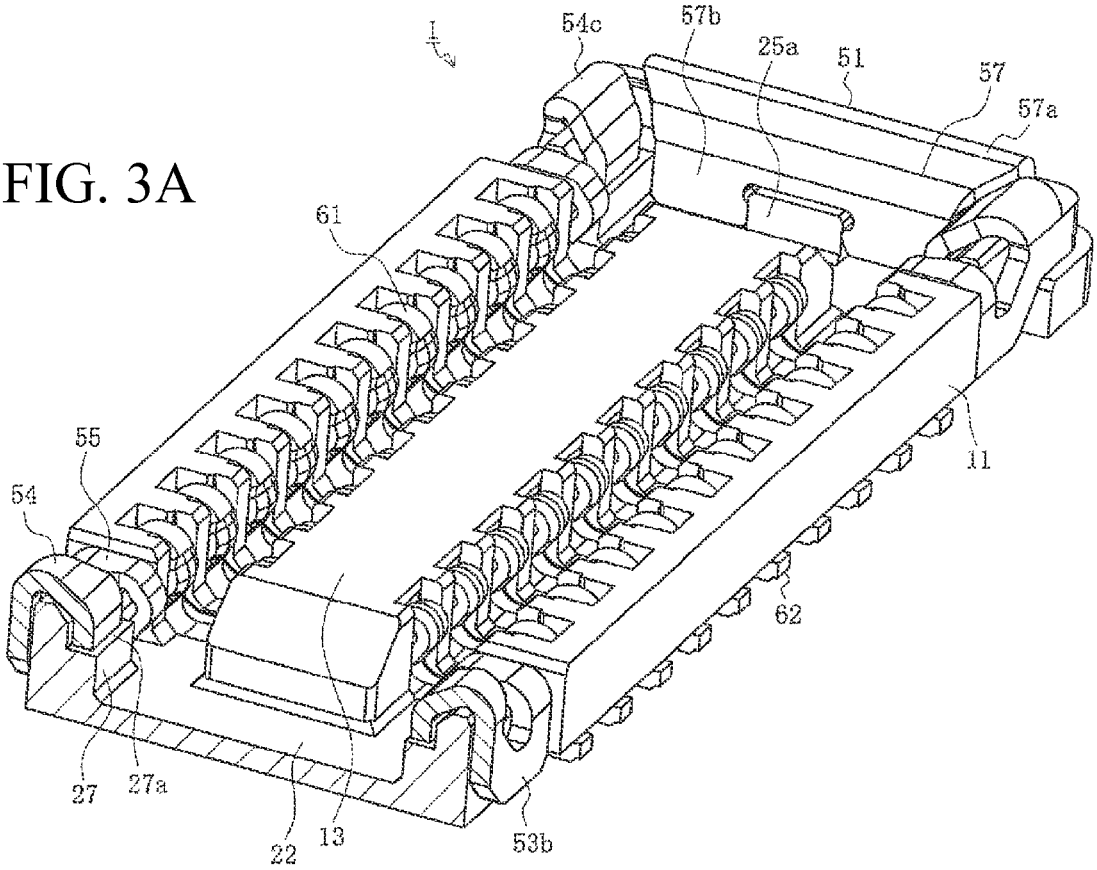
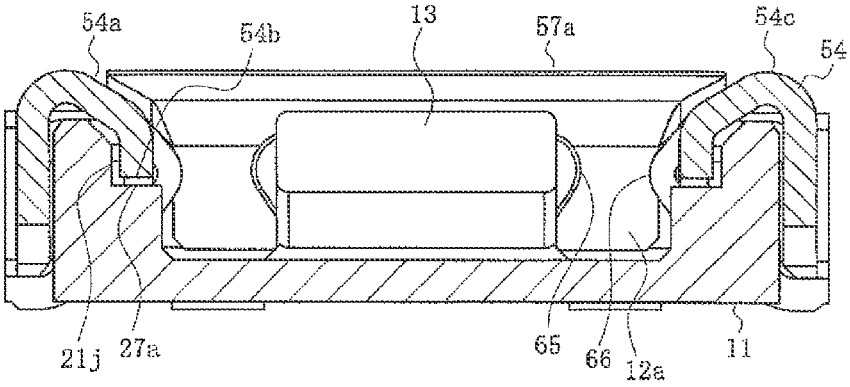
FIG. 3B

FIG. 6A
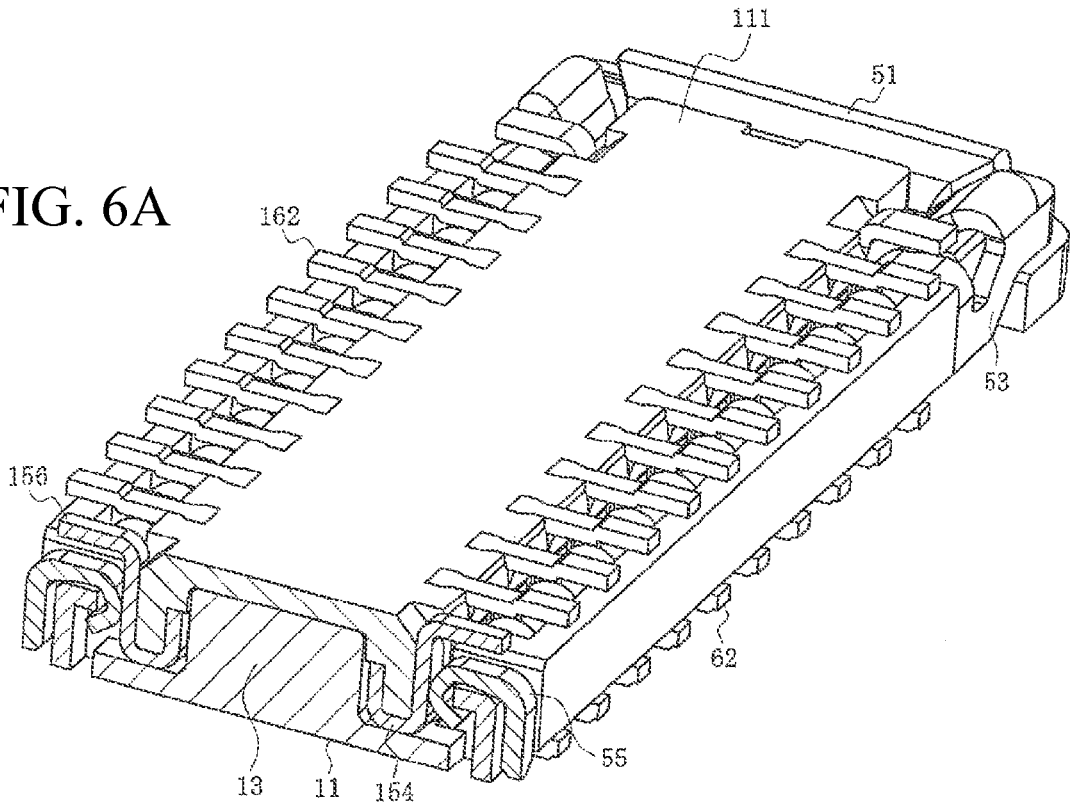
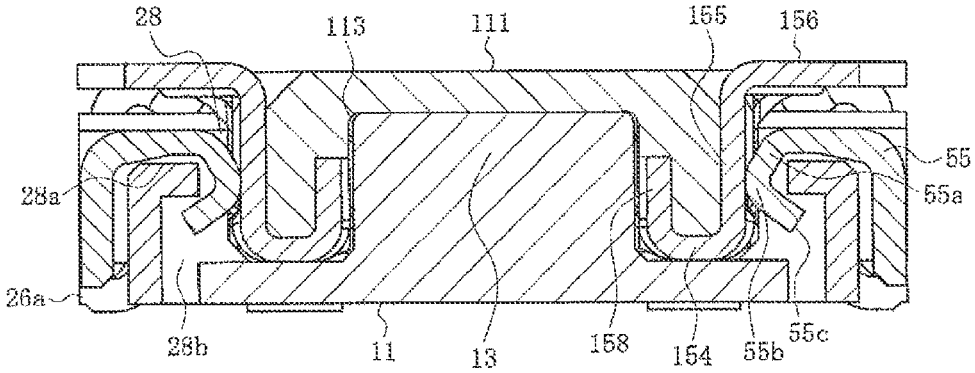
FIG. 6B

CONNECTOR

REFERENCE TO RELATED APPLICATIONS

The Present Disclosure claims priority to prior-filed Japanese Patent Application No. 2013-256578, entitled "Connector," filed on 12 Dec. 2013 with the Japanese Patent Office. The content of the aforementioned Patent Application is incorporated in its entirety herein.

BACKGROUND OF THE PRESENT DISCLOSURE

The Present Disclosure relates, generally, to a connector.

Conventional board-to-board connectors are typically used to electrically connect a pair of parallel circuit boards. These connectors are mounted on the surfaces of the pair of circuit boards facing each other, and then mated to establish an electrical connection. The reinforcing metal fittings have been proposed which are mounted on both ends to function as locking members for keeping the two connectors mated. An example of this type of connector is disclosed in U.S. Pat. No. 8,408,931, the content of which is hereby incorporated herein in its entirety.

FIG. 7 illustrates a perspective view of a conventional connector and reinforcing fitting. Referring to FIG. 7, 811 is a first housing for a first connector mounted on a first circuit board (not shown), and 911 is a second housing for a second connector mounted on a second circuit board (not shown). A plurality of first terminals (not shown) are provided in the first housing 811, and a plurality of second terminals (not shown) are provided in the second housing 911. When the first connector and the second connector are mated, the opposing first and second terminals make contact with each other, and an electrical connection is established between the first circuit board and the second circuit board.

The first housing 811 includes a pair of side wall portions 814 extending in the longitudinal direction, and a pair of mating guide portions 821 connected to both ends of the side wall portion 814 in the longitudinal direction. A mating recessed portion 822 is formed in each of the mating guide portions 821. Also, a plurality of first terminals 861 is mounted on the side wall portion 814, and a first reinforcing metal fitting 851 is attached to the mating guide portions 821. The second housing 911 also includes a pair of mating protruding portions 922 formed on both ends in the longitudinal direction. A plurality of second terminals 961 is mounted on the second housing 911, and a second reinforcing metal fitting 951 is attached to the mating protruding portions 922.

When the first connector and the second connector are mated, the corresponding first terminals 861 and second terminals 961 come into contact with each other. In this way, an electrical connection is established between the first circuit board and the second circuit board. Also, the mating protruding portions 922 are inserted into the mating recessed portion 822 of the mating guide portion 821. Then, an engaging protrusion 858 on the first reinforcing metal fitting 851 formed so as to protrude into the mating recessed portion 822 engages a side portion of the second reinforcing metal fitting 951. In this way, the first connector and the second connector are locked, and remain mated.

However, the first housing 811 or second housing 911 in conventional connectors is sometimes damaged or broken during the mating operation. When a first connector mounted on a first circuit board is mated with a second connector mounted on a second circuit board, the operator may not be able to see the mating surface of the first housing 811 and the mating surface of the second housing 911 due to the operating conditions, and may have to fumble about before performing the mating operation. The operator may having difficulty seeing the mating surface of the first housing 811 and the mating surface of the second housing 911 because newer board-to-board connectors have become more compact and have a lower profile. In this case, the operator may adjust the position of the second housing 911 relative to the first housing 811 while sliding the mating surface of the second housing 911 along the mating surface of the first housing 811 before inserting the mating protruding portion 922 of the second housing 911 into the mating recessed portion 822 of the first housing 811.

Sometimes, when the alignment of the first housing 811 and the second housing 911 is incomplete, force may be applied to the first housing 811 and the second housing 911 in the mating direction. In this case, a portion of the mating surface of the first housing 811 or a portion of the mating surface of the second housing 911 may sustain a large amount of force and become damaged or broken. Specifically, because the mating guide portions 821 formed on both ends of the first housing 811 in the longitudinal direction are relatively thin, they are easily broken when the end portions of the second housing 911 in the longitudinal direction strike them at an oblique angle.

Connecting the first reinforcing metal fitting 851 and the second reinforcing metal fitting 951 to the power lines of the first circuit board and the second circuit board, and using the first reinforcing metal fitting 851 and the second reinforcing metal fitting 951 as the electrical circuit connecting components has been considered, but the engaging protrusion 858 on the first reinforcing metal fitting 851 is not sufficiently flexible. When the electronic device in which the first circuit board and the second circuit board are mounted is dropped or subjected to an external force, the resulting vibrations and impacts may cause a temporary disruption in the electrical connection between the first reinforcing metal fitting 851 and the second reinforcing metal fitting 951, also known as a power flicker.

SUMMARY OF THE PRESENT DISCLOSURE

It is an object of the Present Disclosure to solve the aforementioned problems by providing a connector able to maintain highly reliable mating of opposing connectors and maintain a reliable electrical connection between opposing metal fittings without damaging or breaking the mating guide portions on the connector main bodies during the mating process by arranging a reinforcing metal fitting on the mating guide portions on the longitudinal ends of the connector main body and separating the contact arm portions of the reinforcing metal fittings from the side guide portions.

The connector of the Present Disclosure comprises a connector main body, terminals mounted in the connector main body, and a reinforcing main fitting mounted in the connector main body. The connector main body includes a mating guide portion formed on both longitudinal ends, the mating guide portion mating with an opposing mating guide portion formed on both longitudinal ends of the opposing connector main body of an opposing connector. The reinforcing metal fitting includes a pair of left and right contact arm portions, and a pair of left and right side guide portions disposed in the mating guide portions. The side guide portions guide the opposing mating guide portions, and the contact arm portions establish contact with the opposing reinforcing metal fitting mounted in the opposing connector main body when the connector main body is mated with the opposing connector main body.

In another connector of the Present Disclosure, the reinforcing metal fitting includes a main body portion extending in the transverse direction of the connector main body, and a pair of left and right connecting arm portions having a base end connected to both ends of the main body portion. The contact arm portions are connected to the free end of the connecting arm portions, and the side guide portions are connected at a position closer to the base end than to the free end of the connecting arm portions. In another connector, the mating guide portion includes a mating recessed portion receiving the inserted opposing mating guide portion, and a pair of left and right inner wall side surfaces in the mating recessed portion extending in the longitudinal direction of the connector main body. The side guide portions covering at least a portion of the inner wall side surfaces. In another connector, the mating guide portion includes an inner wall end surface in the mating recessed portion extending in the transverse direction of the connector main body, and the reinforcing metal fitting includes a central guide portion covering at least a portion of the inner wall end surface. The central guide portion guides the opposing mating guide portion when the connector main body is mated with the opposing connector main body of the opposing connector. In another connector, the side guide portions are elastically displaceable downward and outward by deformation of the connecting arm portions, and the displacement downward and outward is stopped when the bottom end portion of the side guide portions comes into contact with a stopping portion. In another connector, the contact arm portions are elastically displaceable downward and outward even when downward and outward displacement of the side guide portions has been stopped. In another connector, the contact arm portion includes a downward curving portion with a protruding curved surface and a bottom end portion, and the bottom end portions are displaced outward and inserted into contact arm portion bottom end accommodating holes formed in the connector main body when the downward curving portions come into contact with the opposing reinforcing metal fitting.

In the Present Disclosure, a reinforcing metal fitting is arranged on each of the mating guide portions on the longitudinal ends of the connector main body, and the contact arm portions of the reinforcing metal fittings are separated from the side guide portions. As a result, the Present Disclosure can provide a connector able to maintain highly reliable mating of opposing connectors and maintain a reliable electrical connection between opposing metal fittings without damaging or breaking the mating guide portions on the connector main bodies during the mating process.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIG. 3A is a perspective view of the first connector taken along Line A-A in FIG. 1 that helps illustrate the relationship between the housing and the metal fitting FIG. 3B is an elevated front view of the embodiment depicted in FIG. 3A;

FIG. 6A is a perspective view of the mated first connector and second connector taken along Lines B-B and C-C in FIG. 5 showing the connectors after the mating process has been completed FIG. 6B is a front view of the cross-sectional surface depicted in FIG. 6A.

DESCRIPTION OF THE PREFERRED EMBODIMENTS

Figure 1:
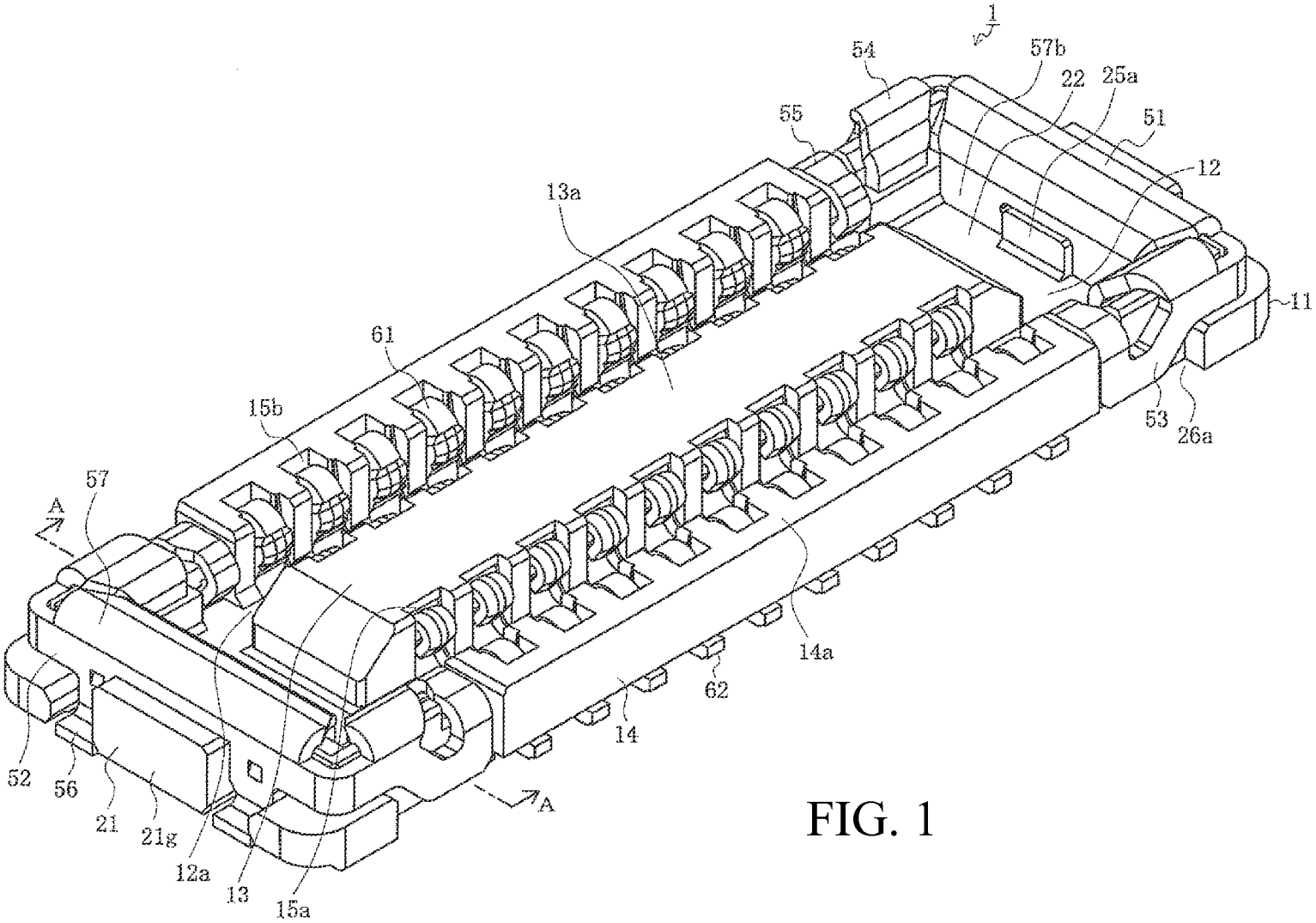
FIG. 1 is a perspective view of a first connector in an embodiment of the Present Disclosure from the mating surface.
Figure 2:
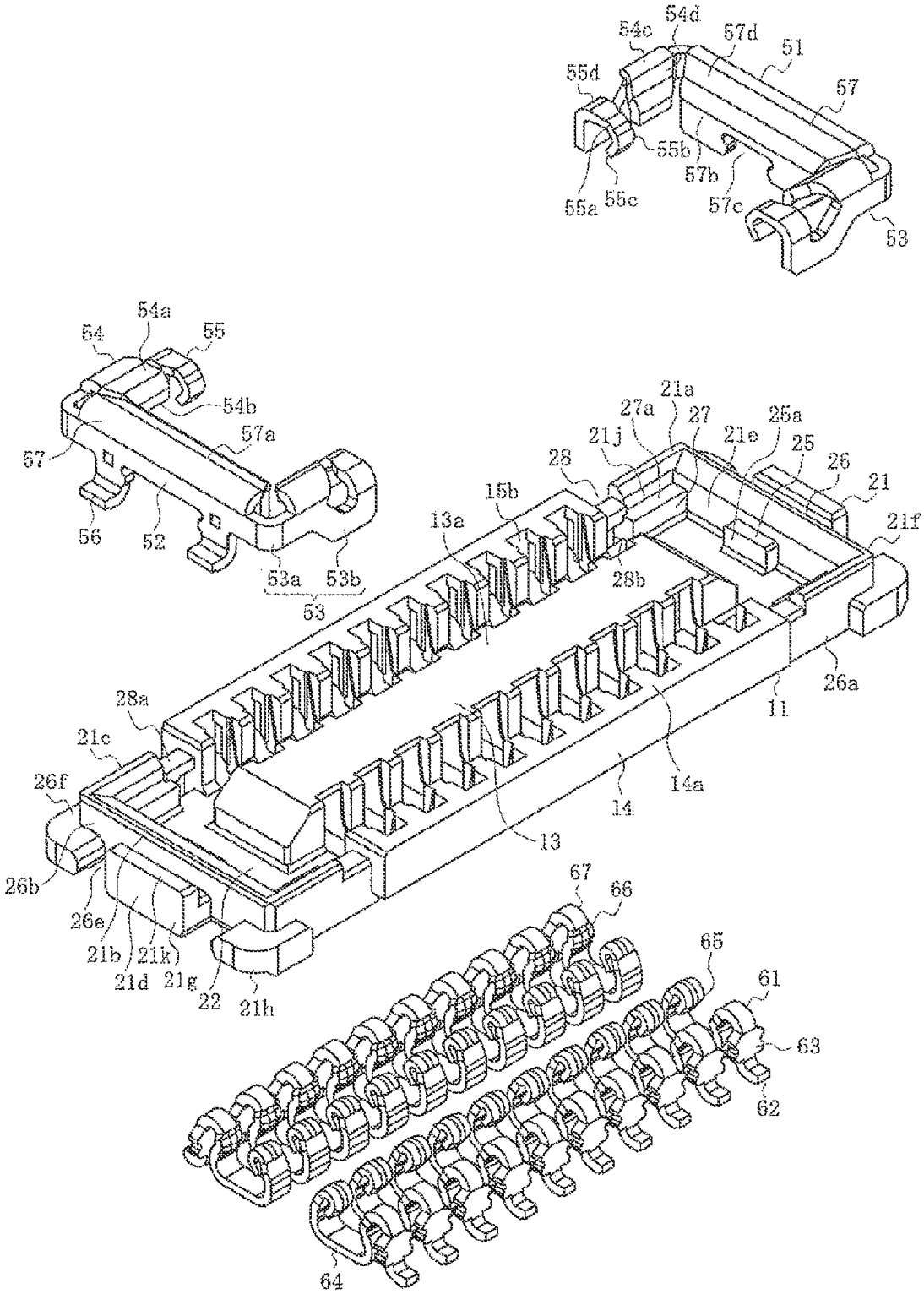
FIG. 2 is an exploded view of the first connector of FIG. 1.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Further, the Present Disclosure is an explanation of a configuration of a connector in an embodiment, with reference to the Figures. In the Figures, portions may have been enlarged for the sake of convenience in order to more easily explain the characteristics of the Present Disclosure, and the dimensional ratios between elements depicted in the drawings may not be the same as those of the actual elements. The materials mentioned in the following explanation are mere examples, and may be different from those of actual elements. Many modifications are possible without departing from the spirit and scope of the Present Disclosure.

Referring to FIGS. 1-3B, 1 is the first connector which is one of the pair of board-to-board connectors in the present embodiment. The first connector 1 is a surface mounted connector which is mounted on the surface of a first board (not shown), and mated with another connector or the second connector 101 described below. Also, 101 is the second connector which is the other one of the pair of board-to-board connectors in the present embodiment. This is also a surface mounted connector and is mounted on the surface of a second board (not shown). The first connector 1 and the second connector 101 in the present embodiment preferably establish an electrical connection between the first board and the second board. The first board and the second board can also be printed circuit boards used in electronic devices, flexible flat cables (FFC), flexible printed circuit (FPC) boards, or any other type of board.

The first connector 1 has a first housing 11, which is an integrally molded connector main body made of an insulating material such as a synthetic resin. As shown in the Figures, the first housing 11 has a rectangular thick plate-like shape, and has a rectangular recessed portion 12 with a surrounded perimeter formed on the side receiving the inserted second connector 101; that is, the mated surface (the upper side in FIG. 3 (*b*)). This first connector 1 is 7.0 mm long, 2.5 mm wide, and 0.6 mm thick, but the dimensions can be changed if necessary. A first protruding portion 13 is integrally formed inside the recessed portion 12 of the first housing 11 as an island. Side wall portions 14 are integrally formed with the first housing 11 and extend parallel to the first protruding portion 13 on both sides of the first protruding portion 13.

Here, the first protruding portion 13 and the side wall portions 14 protrude upward from the bottom surface of the recessed portion 12, and extend in the longitudinal direction of the first housing 11. A recessed groove portion 12*a* is formed as a portion of the recessed portion 12 on both ends of the first protruding portion 13 between the first protruding portion 13 and the side wall portion 14. These slender recessed portions extend in the longitudinal direction of the first housing 11. In the example shown, there is only a single first protruding portion 13. However, there may be one or more of these protruding portions. The first protruding portion 13 is 0.4 mm wide, but this dimension can be changed if necessary.

Here, a groove-shaped first terminal accommodating inner cavity 15*a* is formed on both side surfaces of the first protruding portion 13. A groove-shaped first terminal accommodating outer cavity 15*b* is also formed on both inside surfaces of the side wall portions 14. The first terminal accommodating inner cavity 15*a* and first terminal accommodating outer cavity 15*b* are connected to and integrated with the bottom surface of the recessed groove portion 12*a*. When the first terminal accommodating inner cavity 15*a* and the first terminal accommodating outer cavity 15*b* are explained collectively, they will be referred to simply as the first terminal accommodating cavities 15.

Ten first terminal accommodating cavities 15 are formed on both sides of the first protruding portion 13 at a pitch of 0.2 mm. There are ten first terminals 61 provided on both sides of the first protruding portion 13 at a pitch of 0.2 mm which are accommodated in each of the first terminal accommodating cavities 15. The number and the pitch of the first terminal accommodating cavities 15 can be changed if necessary.

Each first terminal 61 is an integrally formed conductive metal plate which has been stamped and bent, and has a held portion 63, a tail portion 62 connected to the bottom end of the held portion 63, an upper side connecting portion 67 connected to the upper end of the held portion 63, a second contact portion 66 formed near the end of the upper side connecting portion 67 on the inside, a lower side connecting portion 64 connected to the second contact portion 66, and a first contact portion 65 formed near the free end of the lower side connecting portion 64. The held portion 63 extends vertically; that is, in the thickness direction of the first housing 11, and is inserted into and held by the first terminal accommodating outer cavity 15*b*. The tail portion 62 is bent towards and connected to the held portion 63, extends transversely; that is, outward in the transverse direction of the first housing 11, and is connected using solder to a connection pad linked to a conductive trace on the first board. The upper side connecting portion 67 is bent towards and connected to the held portion 63, and extends inward in the transverse direction of the first housing 11.

A second contact portion 66 is formed on the inner end of the upper side connecting portion 67, bends downward, and is curved so as to protrude inward in the transverse direction of the first housing 11. The lower side connecting portion 64 has a U-shaped side surface profile and is connected to the bottom end of the second contact portion 66. A first contact portion 65 formed on the free end of the lower side connecting portion 64 near the upper end on the inside is bent into a U-shape, and is curved so as to protrude outward in the transverse direction of the first housing 11.

The first terminal 61 is inserted into the first end accommodating cavity 15 from the mounting surface side (the bottom side in FIG. 3 (*b*)), and the held portion 63 is interposed on both sides between the side walls of the first terminal accommodating outer cavity 15*b* formed on the inside surface of the side wall portion 14 to secure the terminal in the first housing 11. In this state, the first terminal 61 is loaded inside the first housing 11 with the first contact portion 65 and the second contact portion 66 positioned facing the left and right sides of the recessed groove portion 12*a*. The first terminal 61 is integrally formed by bending a metal plate, and has a certain degree of elasticity. As should be clear from the shape, the interval between the first contact portion 65 and the second contact portion 66 facing each other is elastically deformable. In other words, when a second terminal 161 on the second connector 101 is inserted between the first contact portion 65 and the second contact portion 66, the interval between the first contact portion 65 and the second contact portion 66 is expanded elastically.

A first protruding end portion 21 is arranged as a first mating guide portion on both ends of the first housing 11 in the longitudinal direction. A protruding end recessed portion 22 is formed as a section of the recessed portion 12 in each of the first protruding end portions 21. The protruding end recessed portions 22 are rectangular recessed portions, and connect to both ends of the recessed groove portions 12*a* in the longitudinal direction. When the first connector 1 and the second connector 101 are mated, the protruding end recessed portions 22 function as insertion recessed portions into which a second protruding end portion 122 on the second connector 101 explained below has been inserted.

The first protruding end portions 21 have a side wall extending portion 21*c* extending in the longitudinal direction of the first housing 11 from both longitudinal ends of the side wall portion 14, and an end wall portion 21*b* extending in the transverse direction of the first housing 11 and connected at both ends to the side wall extending portion 21*c*. In each first protruding end portion 21, a continuous C-shaped side wall is formed with the end wall portion 21*b* and the side wall extending portions 21*c* connected at both ends to define three sides of the rectangular mating recessed portion 22.

A first reinforcing metal fitting 51 is mounted as a reinforcing fitting on the first protruding end portion 21. The first reinforcing metal fitting 51 is accommodated and held inside a first metal fitting holding recessed portion 26 formed in the first protruding end portion 21. When viewed from the mating surface, the first metal fitting holding recessed portion 26 is a continuous C-shape opening in the upper surface 21*a* of the first protruding end portion 21, and forming a slit-shaped space extending from the upper surface 21*a* downward in the thickness direction of the first housing 11.

The C-shaped side wall formed by the end wall portions 21*b* and the side wall extending portion 21*c* is divided into an inner wall portion 21*f* and outer wall portions 21*k* by the first metal fitting holding recessed portion 26. The inner wall portion 21*f* is continuously C-shaped and is linked to both ends of the side wall portion 14 in the longitudinal direction. Each outer wall portion 21*k* is divided into three portions—a central portion 21*d* and left and right corner portions 21*h*-*b* the first arm portion accommodating opening 26*f*, the second arm portion accommodating opening 26*a*, and the board connecting portion accommodating opening 26*e* of the first metal fitting holding recessed portion 26. The second arm portion accommodating opening 26*a* opens into the outer surface of the side wall extending portion 21*c*, the board connecting accommodating opening 26*e* opens into the outer surface of the end wall portion 21*b*, and the first arm portion accommodating opening 26*f* opens into the outer surface of the connected portion of the side wall extending portion 21*c* and the end wall portion 21*b*. The outer wall surface 21*g* of the central portion 21*d* is the outermost side surface of the first housing 11 in the longitudinal direction.

A contact arm portion accommodating opening 28 is formed in the section of the inner wall portion 21*f* adjacent to the side wall portion 14 of the side wall extending portion 21*c*. The upper surface 28*a* of the contact arm portion accommodating opening 28 is lower than the upper surface 21*a*, and the opening itself communicates with the upper end of the second arm portion accommodating opening 26*a*. A contact arm portion lower end accommodating hole 28*b* is also formed in the inner surface of the contact arm portion accommodating opening 28.

An inner end protruding portion 25 protruding towards the first protruding portion 13 is formed in the inner wall end surface 21*e* forming the surface on the mating recessed portion 22 side of the section of the inner wall portion 21*f* corresponding to the end wall portion 21*b*. The opposing flat surface 25*a* of the inner end protruding portion 25 facing the first protruding portion 13 is a flat surface functioning as a reference surface for positioning each component of the first connector 1 in the longitudinal direction of the first housing 11. Inside protruding portions 27 protruding towards each other are formed in a pair of inner wall surfaces 21*j* formed as the surfaces on the mating recessed portion 22 side of the inner wall portion 21*f* in the section corresponding to the side wall extending portion 21*c*. A supporting surface 27*a* on the mating surface side of the inner protruding portion 27 is a flat surface supporting the side guide portion 54 of the first reinforcing metal fitting 51.

In the present embodiment, the first reinforcing metal fitting 51 includes a slender band-like first main body portion 52, which is integrally formed by stamping and bending a metal plate and which extends in the transverse direction of the first housing 11, a slender band-like connecting arm portion 53 connected to both the left and right ends of the first main body portion 52, a side guide portion 54 connected to the upper end of the connecting arm portion 53, a contact arm portion 55 similarly connected to the upper end of the connecting arm portion 53, a board connecting portion 56 connected to the lower end of the first main body portion 52, and a central guide portion 57 connected to the upper end of the first main body portion 52. The first main body portion 52 is fixed to the central portion 21*d* of the outer wall portion 21*k*. The connecting arm portion 53 is elastically displaceable in the vertical and transverse directions. The connecting arm portion 53 includes a first connecting arm portion 53*a* ranging from the first main body portion 52 to the side guide portion 54, and a second connecting arm portion 53*b* ranging from the side guide portion 54 to the contact arm portion 55. The first connecting arm portion 53*a* is bent at nearly a right angle when viewed from the mounting surface (from the bottom in FIG. 3 (*b*)). When the first reinforcing metal fitting 51 is viewed from the mounting surface, the first main body portion 52 and the contact arm portions 53 form a continuous C-shape corresponding to the first metal fitting holding recessed portion 26.

When the first reinforcing metal fitting 51 is mounted on the first protruding end portion 21 as shown in FIG. 1, the first connecting arm portion 53*a* is accommodated inside the first arm portion accommodating opening 26*f* and the lower end is positioned above the upper surface of the corner portions 21*h*. In this way, the first connecting arm portion 53*a* can be elastically displaced in the mounting surface direction and in the outward direction. The second connecting arm portion 53*b* is bent into a shape resembling a crank including a sloping central portion when viewed from the side. The leading end has a shape which positioned it closer to the mounting surface than the first connecting arm portion 53*a*. Compared to a linear shape, it is longer as a whole and the portion functioning as a spring is also longer. The second connecting arm portion 53*b* is accommodated inside a second arm portion accommodating opening 26*a* opening below, and is elastically displaceable in the mounting surface direction and in the outward direction.

The base ends of the pair of board connecting portions 56 extend along the same plane as the first main body portion 52, and the free ends are band-like components curving outward with respect to the longitudinal direction of the first housing 11. The board connecting portions 56 are accommodated inside the board connecting portion accommodating opening 26*e* with the bottom of the free ends being connected using, for example, solder to connecting pads linked to conductive traces on the first board. The conductive traces are typically power lines.

When the first reinforcing metal fitting 51 is mounted in the first protruding end portion 21 as shown in FIG. 1, the central guide portion 57 has a shape and size which covers the upper surface 21*a* and most of the inner wall end surface 21*e* of the portion of the inner wall portion 21*f* corresponding to the end wall portion 21*b*. The central guide portion 57 includes an upper side covering portion 57*a* whose base end is connected to the upper end of the first main body portion 52 and whose leading end curves downward at an angle, and an inside covering portion 57*b* whose base end is connected to the upper side covering portion 57*a* and whose leading end extends downward.

A protruding portion accommodating opening 57*c* for accommodating the inner end protruding portion 25 is formed in the lower end central portion of the inside covering portion 57*b*, and the opposing flat surface 25*a* is exposed inside the mating recessed portion 22 even when the first reinforcing metal fitting 51 is mounted on the first protruding end portion 21. The protruding portion accommodating opening 57*c* guides the inner end protruding portion 25 to position the first reinforcing metal fitting 51 with respect to the first protruding end portion 21.

A sloped portion 57*d* whose outer surface is an inclined flat or convex curved surface is present near the connection between the upper side covering portion 57*a* and the inside covering portion 57*b*. When the first connector 1 is mated with the second connector 101, the sloped portion 57*d* functions as a guiding surface for smoothly guiding the second protruding end portion 122 of the second connector 101 into the mating recessed portion 22.

When the first reinforcing metal fitting 51 is mounted in the first protruding end portion 21 as shown in FIG. 1, the side guide portion 54 has a shape and size which covers the upper surface 21*a* and most of the inner wall side surface 21*j* of the portion of the inner wall portion 21*f* corresponding to the side wall extending portion 21*c*. Each side guide portion 54 includes an upper side covering portion 54*c* whose base end is connected to the upper end of the connecting arm portion 53 and whose leading end curves downward at an angle, and an inside covering portion 54*a* whose base end is connected to the upper side covering portion 54*c* and whose leading end extends downward.

As shown in FIGS. 3A-3B, when the first reinforcing metal fitting 51 is mounted on the first protruding end portion 21, the lower end portion 54*b* of the inside covering portion 54*a* is positioned above the supporting surface 27*a* of the inner protruding portion 27 and towards the inside with respect to the inner wall side surface 21*j*. When the first connector 1 and the second connector 101 have been mated, the second protruding end portion 122 of the second connector 101 is abutted, the side guide portion 54 is pushed down and pushed apart, and the supporting surface 27*a* and the inner wall side surface 21*j* are abutted. Here, the supporting surface 27*a* and the inner wall side surface 21*j* function as stopping portions which stop the displacement of the side guide portion 54.

A sloped portion 54*d* whose outer surface is an inclined flat or convex curved surface is present near the connection between the upper side covering portion 54*c* and the inside covering portion 54*a*. When the first connector 1 is mated with the second connector 101, the sloped portion 54*d* functions as a guiding surface for smoothly guiding the second protruding end portion 122 of the second connector 101 into the mating recessed portion 22.

The contact arm portion 55 includes an upper curving portion 55*d* with an upward facing convex curved surface whose base end is connected to the upper end or leading end of the second connecting arm portion 53*b*, the plate-shaped contact main body portion 55*a* whose base end is connected to the leading end of the upper curving portion 55*d* and extends inward and downward with respect to the first housing 11, and a lower curving portion 55*b* with a downward facing convex curved surface whose base end is connected to the leading end of the contact main body portion 55*a* and whose lower end portion 55*c* is directed outward with respect to the transverse direction of the first housing 11. When the first reinforcing metal fitting 51 is mounted on the first protruding end portion 21, the upper curving portion 55*d* is located above the upper surface 28*a* of the contact arm portion accommodating opening 28, and the lower end portion 55*c* can be inserted into the contact arm portion lower end accommodating hole 28*b*. Thus, even when the second reinforcing metal fitting 151 of the second connector 101 makes contact from above when the first connector 1 and the second connector 101 have been mated, the upper curving portion 55*d* can be displaced downward, and the lower end portion 55*c* of the lower curving portion 55*b* can be displaced outward in the transverse direction of the first housing 11.

Also, when the first reinforcing metal fitting 51 is mounted on the first protruding end portion 21, the apex of the upper curving portion 55*d* positioned at the very top of the contact arm portion 55 is at the same level or lower than the upper surface 14*a* of the side wall portion 14 and the upper surface 13*a* of the first protruding portion 13. Also, the apex of the upper side covering portion 57*a* of the central guide portion 57 and the apex of the upper side covering portion 54*c* of the side guide portion 54 are at a level higher than the upper surface 14*a* of the side wall portion 14 and the upper surface 13*a* of the first protruding portion 13.

The apex of the upper side covering portion 57*a* of the central guide portion 57 and the apex of the upper side covering portion 54*c* of the side guide portion 54 are at about the same height, and the upper surface 14*a* of the side wall portion 14 and the upper surface 13*a* of the first protruding portion 13 are at about the same height. Also, when the first terminals 61 are accommodated and held inside the first end accommodating cavity 15, each component is at the same level or lower than the upper surface 14*a* of the side wall portion 14 and the upper surface 13*a* of the first protruding portion 13. At least a portion of the first contact portion 65 and at least a portion of the second contact portion 66 protrude from the left and right side walls of the recessed groove portion 12*a* and into the recessed groove portion 12*a*.

Figure 4:
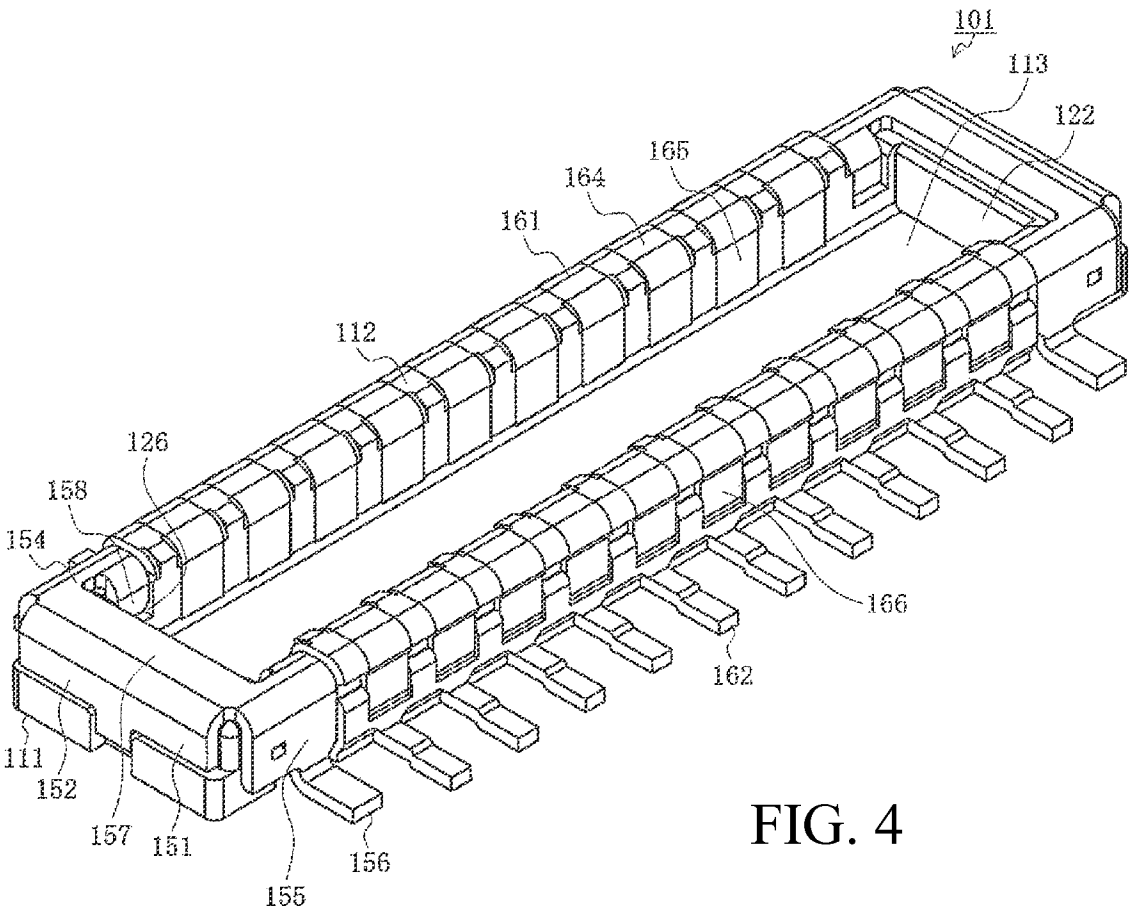
FIG. 4 is a perspective view of a second connector in the embodiment of the Present Disclosure.

Referring to FIG. 4, the second connector 101 has a second housing 111, which is an integrally molded connector main body made of an insulating material such as a synthetic resin. As shown in the Figure, the second housing 111 has a rectangular thick plate-like shape, and is 5.0 mm long, 1.5 mm wide, and 0.5 mm thick, but the dimensions can be changed if necessary. The second housing 111 includes an integrally formed slender recessed groove portion 113 extending in the longitudinal direction of the second housing 111 on the side mated with the first connector 1, that is, in the mated surface side (the upper side in the drawings), and second protruding portions 112 serving as slender protruding portions, which define the outside of the recessed groove portion 113 and extend in the longitudinal direction of the second housing 111. The second protruding portions 112 extend along both sides of the recessed groove portion 113 and along both sides of the second housing 111. A second terminal 161 is arranged on each second protruding portion 112. As shown in the Figure, the bottom portion of the recessed groove portion 113 closes the side mounted on the second board, that is, the mounting surface (the bottom surface in the Figure). In the example shown, there are two second protruding portions 112, but one or more may be used. The width of the recessed groove portion 113 is 0.7 mm, but this dimension can be changed if necessary.

Each second terminal 161 is an integrally formed conductive metal plate which has been stamped and bent, and has a main body (not shown), a tail portion 162 connected to the bottom end of the main body portion, a first contact portion 165 connected to the upper end of the main body portion, a connecting portion 164 connected to the upper end of the first contact portion 165, and a second contact portion 166 connected to the outside end of the connecting portion 164. The main body portion, while not shown, surrounds the periphery and is held by the second housing 111. The tail portion 162 is connected at the bottom end extending in the transverse direction of the main body portion; that is, in the transverse direction of the second housing 111, extends outward from the second housing 111, and is connected, for example, using solder, to a connection pad connected to a conductive trace on the second board. The conductive trace is typically a signal line.

The first contact portion 165 is flat and plate-shaped, is connected to the main body portion, and extends vertically, that is, in the thickness direction of the second housing 111. The connecting portion 164 is bent and connected to the first contact portion 165, and extends outward in the transverse direction of the second housing 111. The second contact portion 166 is bent and extends downward, and is connected to the outer end of the connecting portion 164.

Each second terminal 161 is integrated with the second housing 111 using overmolding or insert molding. In other words, the second housing 111 is molded by filling a mold cavity in which the second terminals 161 have been set with a resin. This embeds the main body portion of each second terminal 161 in the second housing 111, and integrally mounts the terminal in the second housing 111 so that the surfaces of the first contact portion 165, the connecting portion 164, and the second contact portion 166 are exposed on the side surfaces of the second protruding portions 112 and on the mounting surface. Here, there are ten second terminals 161 arranged on the left and right at a pitch of 0.2 mm. The pitch and number of second terminals 161 can be changed if necessary.

A second protruding end portion 122 is arranged as a second mating guide portion on both ends of the second housing 111 in the longitudinal direction. Each thick second protruding end portion 122 extends in the transverse direction of the second housing 111 and both ends are connected to both ends of each second protruding portion 112 in the longitudinal direction. The upper surface has a substantially rectangular shape. When the first connector 1 and the second connector 101 have been mated, the second protruding end portion 122 function as an insertion protruding portion which has been inserted into the protruding end recessed portion 22 of the first protruding portion 21 on the first connector 1.

A second reinforcing metal fitting 151 is also mounted on the second protruding end portion 122. The second reinforcing metal fitting 151 is arranged along the outer surface of the second housing 11 in the second protruding end portion 122, and the leading end of the holding protruding piece 158 is accommodated and held in the second metal fitting holding recessed portion 126 formed on an inside surface near both ends of the second protruding portion 112 in the longitudinal direction.

In the present embodiment, the second reinforcing metal fitting 151 is integrally formed by stamping and bending a metal plate, and includes a slender band-like second main body portion 152 extending in the transverse direction of the second housing 111, a central covering portion 157 connected to the upper end of the second main body portion 152, a side covering portion 154 connected to both the left and right ends of the central covering portion 157, a holding protruding piece 158 connected to a side edge of the side covering portion 154, a contact side plate portion 155 connected to the other side edge of the side covering portion 154, and a board connecting portion 156 connected to the bottom end of the contact side plate portion 155. The central covering portion 157 is formed in a size and shape covering most of the upper surface of the second protruding end portion 122 when the second reinforcing metal fitting 151 is mounted on the second protruding end portion 122 as shown in the drawing.

A side covering portion 154 extends from both the left and right ends of the central covering portion 157 in the longitudinal direction of the second housing 111, and covers the upper surface near both ends of the second protruding portion 112 in the longitudinal direction. The contact side plate portion 155 covers the outside surfaces near both ends of the second protruding portion 112 in the longitudinal direction. The side covering portion 154 and the holding protruding piece 158 and contact side plate portion 155 connected to both side edges of the side covering portion 154 form a continuous U-shape, which straddles the inside surface of the second protruding portion 112, the upper surface of the second protruding portion 112, and the outside surface of the second protruding portion 112 near both ends of the second protruding portion 112 in the longitudinal direction. The board connecting portion 156 extends outward with respect to the second housing 111, and is connected, for example, using solder to a connecting pad linked to a conductive trace on the second board. This conductive trace is typically a power line. The second main body portion 152, the central covering portion 157, the side covering portion 154, and the holding protruding piece 158 in the second reinforcing metal fitting 151 may be omitted if desired.

Figure 5:
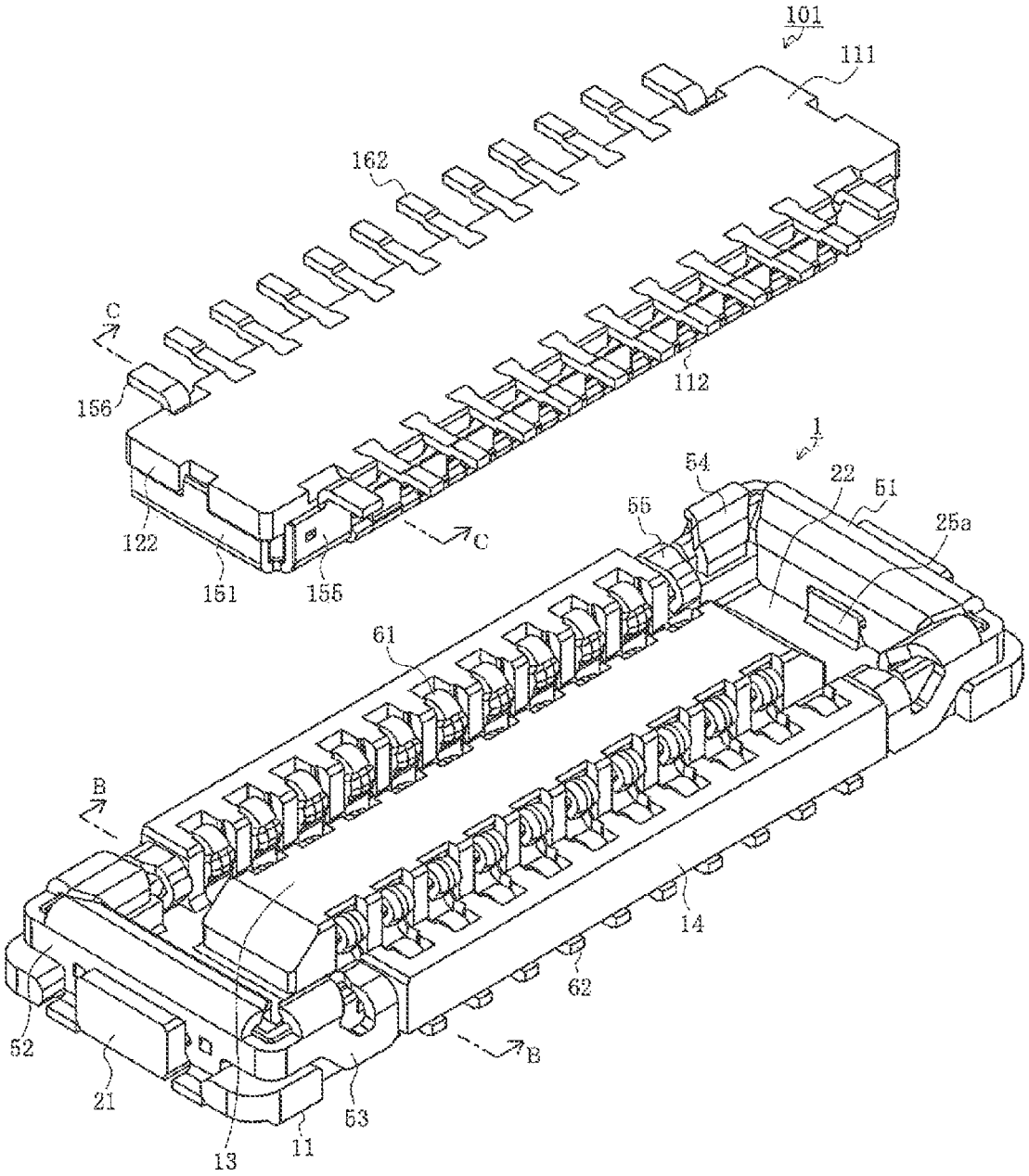
FIG. 5 is a perspective view showing the positional relationship between the first connector of FIG. 1 and the second connector of FIG. 4 during the mating process.
Figure 7:
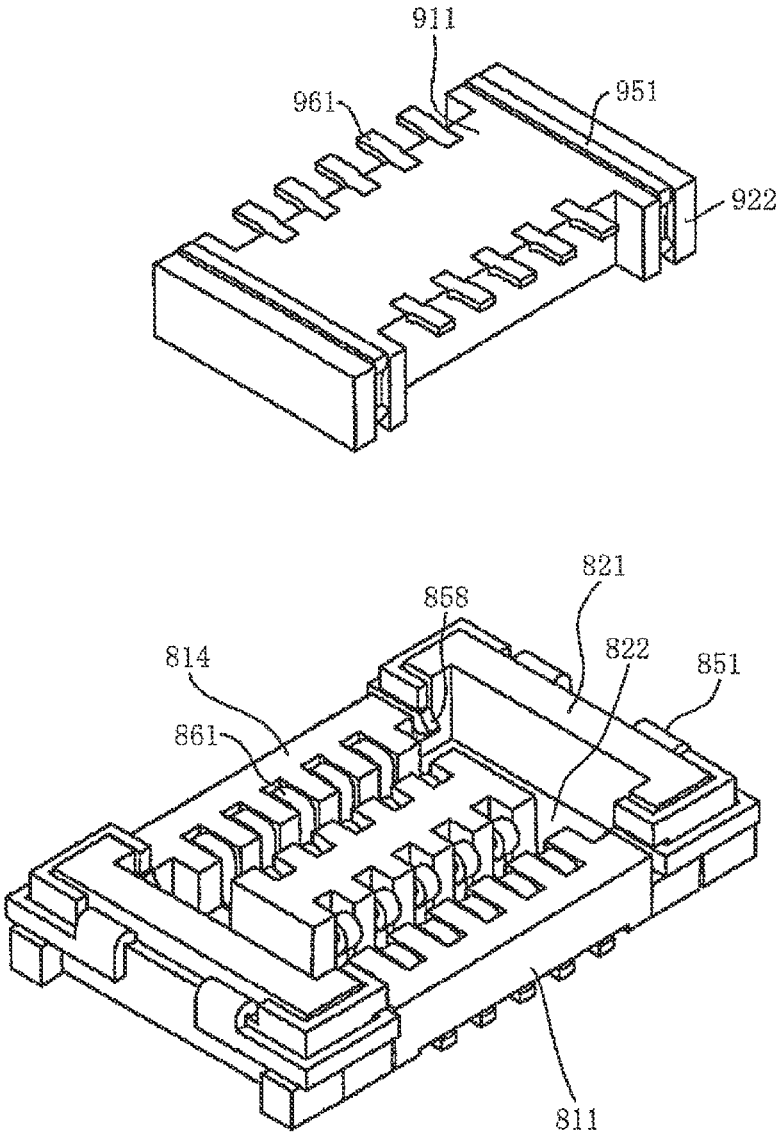
Prior art FIG. 7
FIG. 7 is a perspective view of a conventional connector and reinforcing fitting.

Referring to FIGS. 5-6B, illustrating the positional relationship between the first connector and the second connector, the tail portions 62 of the first terminals 61 on the first connector 1 are connected using solder to connection pads connected to conductive traces on the first board (not shown), and the first board connecting portions 56 of the first reinforcing metal fitting 51 are connected using solder to connecting pads on the first board and surface-mounted on the first board. The conductive trace linked to the connecting pad connected to the tail portion 62 of each first terminal 61 is a signal line, and the conductive trace linked to the connecting pad connected to the board connecting portion 56 of the first reinforcing metal fitting 51 is a power line.

Similarly, the tail portions 162 of the second terminals 161 on the second connector 101 are connected using solder to connection pads connected to conductive traces on the second board (not shown), and the second board connecting portions 156 of the second reinforcing metal fitting 151 are connected using solder to anchoring pads on the second board and surface-mounted on the second board. The conductive trace linked to the connecting pad connected to the tail portion 162 of each second terminal 161 is a signal line, and the conductive trace linked to the connecting pad connected to the board connecting portion 156 of the second reinforcing metal fitting 151 is a power line.

First, as shown in FIG. 5, the operator opposes the mating surface of the first housing 11 of the first connector 1 to the mating surface of the second housing 111 of the second connector 101, aligns the position of the second protruding portion 112 of the second connector 101 with the position of the corresponding recessed groove portion 12*a* in the first connector 1, and aligns the position of the second protruding end portion 122 of the second connector 101 with the position of the corresponding mating recessed portion 22 in the first connector 1 to complete the positioning of the first connector 1 and the second connector 101.

When the first connector 1 and/or second connector 101 is moved closer to the opposing connector, that is, in the mating direction, the second protruding portion 112 and the second protruding end portion 122 of the second connector 101 are inserted into the recessed groove portion 12*a* and the mating recessed portion 22 of the first connector 1. With this, as shown in FIGS. 6A-6B, the mating of the first connector 1 and the second connector 101 is completed, and an electrical connection is established between the first terminals 61 and the second terminals 161.

More specifically, a second terminal 161 of the second connector 101 is inserted between the first contact portion 65 and second contact portion 66 of each first terminal 61, contact is established between the first contact portion 65 of the first terminal 61 and the first contact portion 165 of the second terminal 161, and contact is established between the second contact portion 66 of the first terminal 61 and the second contact portion 166 of the second terminal 161. As a result, an electrical connection is established between the conductive traces linked to connecting pads on the first board connected to the tail portions 62 of the first terminals 61, and the conductive traces linked to connecting pads on the second board connected to the tail portions 162 of the second terminals 161.

However, because the first connector 1 and the second connector 101 are mounted on a large first board and a large second board, the operator cannot see the mating surface of the first connector 1 and the mating surface of the second connector 101, and must fumble about during the mating process. The operator must fumble about because the first connector 1 and the second connector 101 are not properly aligned. For example, the second connector 101 may be misaligned with respect to the first connector 1 in the longitudinal direction, and the mating surface of the second connector 101 may be at an angle with respect to the mating surface of the first connector 1.

When the operator moves the first connector 1 and/or the second connector 101 in the mating direction in this orientation, at least some of the second protruding end portion 122 of the second connector 101 strikes the end wall portion 21*b* of at least some of the first protruding end portion 21 of the first connector 1, and the end wall portion 21*b* is subjected to significant downward force from the second protruding end portion 122 in the mating direction as shown in FIG. 5. However, because in the present embodiment a first reinforcing metal fitting 51 is mounted on the first protruding end portion 21, and the upper surface 21*a* and most of the inner wall end surface 21*e* in the section of the inner wall portion 21*f* corresponding to the end wall portion 21*b* are covered by the central guide portion 57 of the first reinforcing metal fitting 51, the pressing force sustained by the second protruding end portion 122 is transmitted to the first board from the first main body portion 52 of the first reinforcing metal fitting 51 via the board connecting portion 56, and hardly any of the force is transmitted to the end wall portion 21*b*. Therefore, the end wall portion 21*b* is neither damaged nor broken.

Because the central guide portion 57 of the first reinforcing metal fitting 51 has a U-shaped profile, the section modulus and strength of the portion are high. Therefore, even when significant pressing force is transmitted to the end wall portion 21*b* of the first protruding end portion 21 via the second protruding end portion 122, the central guide portion 57 of the first reinforcing metal fitting 51 can effectively stop the force, and hardly any of the force is transmitted to the end wall portion 21*b*. Therefore, the end wall portion 21*b* is neither damaged nor broken when the pressing force is great.

The central guide portion 57 of the first reinforcing metal fitting 51 also includes a sloped portion 57. This slides the second protruding end portion 122 in contact with the central guide portion 57 along the sloped portion 57*d*, and smoothly inserts it into the mating recessed portion 22. Also, the second protruding end portion 122 comes into contact with the side wall extending portion 21*c* of the first protruding end portion 21 when, for example, the second connector 101 shifts in the transverse direction with respect to the first connector 1. However, in the present embodiment, because the upper surface 21*a* and most of the inner wall side surface 21*j* of the inner wall portion 21*f* in the section corresponding to the side wall extending portion 21*c* are covered by the side guide portion 54 of the first reinforcing metal fitting 51, the side wall extending portion 21*c* is neither damaged nor broken by substantial force received from the second protruding end portion 122.

The side guide portion 54 of the first reinforcing metal fitting 51 also includes a sloped portion 54*d*. This slides the second protruding end portion 122 in contact with the side guide portion 54 along the sloped portion 54*d*, and smoothly inserts it into the mating recessed portion 22. Because the apex of the upper side covering portion 57*a* of the central guide portion 57 and the apex of the upper side covering portion 54*c* of the side guide portion 54 are higher than the apex of the upper curving portion 55*d* of the contact arm portion 55 when the second connector 101 shifts with respect to the first connector 1, the second protruding end portion 122 does not initially come into contact with the contact arm portion 55. Therefore, the contact arm portion 55 is flexible and is neither damaged nor broken even though the component is not very strong.

Because the apex of the upper side covering portion 57*a* of the central guide portion 57 and the apex of the upper side covering portion 54*c* of the side guide portion 54 are higher than the apex of the upper surface 14*a* of the side wall portion 14 and the upper surface 13*a* of the first protruding portion 13, the second protruding end portion 122 does not initially come into contact with the side wall portion 14 and the first protruding portion 13. Therefore, the side wall portion 14 and the first protruding portion 13 are neither damaged nor broken.

When the second connector 101 shifts significantly with respect to the first connector 1, the second protruding end portion 122 may not come into contact with the first reinforcing metal fitting 51, but instead make initial contact with a side wall portion 14 and first protruding portion 13. However, even in this case, because the apex of the upper curving portion 55*d* of the contact arm portion 55 and each first terminal 61 is on the same level or lower than the upper surface 14*a* of side wall portion 14 and the upper surface 13*a* of the first protruding portion 13, the contact arm portion 55 and the first terminals 61 do not sustain pressing force from the second protruding end portion 122. Therefore, the contact arm portion 55 and the first terminals 61 are neither damaged nor broken.

Because the second housing 111 of the second connector 101 has a smaller dimension in the transverse direction than the first housing 11 of the first connector 1, the second protruding end portion 122 is stronger and less likely to be damaged than the end wall portion 21*b* of the first protruding end portion 21. Therefore, the second main body portion 152, the central covering portion 157, the side covering portion 154, and the holding protruding piece 158 can be omitted from the second reinforcing metal fitting 151.

When the mating of the first connector 1 and the second connector 101 has been completed, an electrical connection is established between the first terminals 61 and the second terminals 161, and the first reinforcing metal fitting 51 of the first connector 1 and the second reinforcing metal fitting 151 of the second connector 101 engage each other. This establishes an electrical connection between the first reinforcing metal fitting 51 and the second reinforcing metal fitting 151, and an electrical connection is maintained between the power lines.

More specifically, the second reinforcing metal fitting 151 is inserted into the first reinforcing metal fitting 51, and the lower curving portions 55*b* on the left and right contact arm portions 55 of the first reinforcing metal fitting 51 come into contact with the left and right contact side plate portions 155 of the second reinforcing metal fitting 151. At this time, the lower curving portions 55*b* are displaced downward by the relative downward movement of the second reinforcing metal fitting 151, and also displaced outward with respect to the transverse direction of the first housing 11. The spring action of the contact arm portion 55 and connecting arm portion 53 connected to the contact arm portion 55 function as a spring that presses the surface of the lower curving portion 55*b* against the surface of the contact side plate portion 155. Because reliable contact is maintained between the surface of the lower curving portion 55*b* and the surface of the contact side plate portion 155, a reliable electrical connection is maintained between the first reinforcing metal fitting 51 and the second reinforcing metal fitting 151.

Here, the length of the connecting arm portion 53 from the base end connected to both the left and right ends of the first main body portion 52 to the leading end or free end connected to the contact arm portion 55 has spring-like resiliency. Because the free end of the connecting arm portion 53 is the leading end of the second connecting arm portion 53*b* bent into the shape of a crank and positioned downward, the contact arm portion 55 extending upward from the free end positioned downward also has spring-like resiliency up to the lower curving portion 55*b*. Therefore, the lower curving portion 55*b* is positioned on the free end of the connecting arm portion 53 and the contact arm portion 55 which function as a spring along most of their length, and this greatly increases the amount of elastic displacement. Therefore, even when vibrations and impacts generated when the electronic device containing the mounted first board and second board is dropped or experiences an external shock are transmitted, and the second reinforcing metal fitting 151 is displaced relative to the first reinforcing metal fitting 51, the lower curving portion 55*b* maintains contact along the displaced contact side plate portion 155, a reliable electrical connection is maintained between the first reinforcing metal fitting 51 and the second reinforcing metal fitting 151, and a temporary power disruption or power flicker does not occur.

As mentioned above, the second protruding end portion 122 does not make initial contact with the contact arm portion 55 and the contact arm portion 55 does not sustain pressing force from the second protruding end portion 122 even when there is a shift in the second connector 101 with respect to the first connector 1. Therefore, the connecting arm portion 53 and the contact arm portion 55 remain flexible, and the lower curving portion 55*b* can be resiliently and significantly displaced.

When the side guide portion 54 is connected to the middle of the connecting arm portion 53 and the side guide portion 54 is displaced downward and outward, the lower end portion 54*b* of the inside covering portion 54*a* comes into contact with the supporting surface 27*a* of the inside protruding portion 27 and the inner wall side surface 21*j*, and the displacement is stopped. As a result, the upper side covering portion 54*c* does not make contact with the upper surface 21*a* of the inner wall portion 21*f* corresponding to the end wall portion 21*b*, and the upper surface 21*a* is neither damaged nor broken.

Because displacement of the side guide portion 54 is stopped midway, the first connecting arm portion 53*a* of the connecting arm portion 53 is non-displaceable by a moderate amount of force. Only the second connecting arm portion 53*b* is displaceable. Therefore, the lower curving portion 55*b* is displaceable only within a certain range before displacement of the side guide portion 54 is stopped, and is easily displaceable by the spring action of the entire connecting arm portion 53 and the contact arm portion 55. When this range is exceeded, the strong spring action of the relatively short second connecting arm portion 53*b* and contact arm portion 55 causes displacement. Because the lower curving portion 55*b* combines significant displaceability with strong spring action, contact can be maintained with the contact side plate portion 155, a reliable electrical connection can be maintained between the first reinforcing metal fitting 51 and the second reinforcing metal fitting 151, and a temporary power disruption or power flicker does not occur.

As shown in FIGS. 6A-6B, when mating of the first connector 1 and the second connector 101 has been completed, the lower curving portion 55*b* of the contact arm portion 55 is displaced outward by the contact side plate portion 155, and the lower end portion 55*c* is inserted into the contact arm portion lower end accommodating hole 28*b*. When the mated first connector 1 and second connector 101 are to be detached, the first connector 1 and/or the second connector 101 is moved away from the opposing connector in the direction opposite that of mating. This applies force upward in the detachment direction from the first housing 11 in the contact arm portion 55 of the first reinforcing metal fitting 51 holding the second reinforcing metal fitting 151. However, because the lower end portion 55*c* is inserted into and engages the contact arm portion lower end accommodating hole 28*b*, upward displacement of the lower end portion 55*c* is prevented, upcurling of the lower curving portion 55*b* is prevented, and detachment of the contact arm portion 55 from the first housing 11 is prevented.

In the present embodiment, the first connector 1 has a first housing 11, first terminals 61 mounted in the first housing 11, and a first reinforcing metal fitting 51 mounted on the first housing 11. The first housing 11 includes a first protruding end portion 21 formed on both ends in the longitudinal direction, and this first protruding end portion 21 is mated with a second protruding end portion 122 formed on both ends of the second housing 111 of the second connector 101 in the longitudinal direction. The first reinforcing metal fitting 51 includes a pair of left and right contact arm portions 55, and a pair of left and right side guide portions 54 arranged in the first protruding end portion 21. When the first housing 11 and the second housing 111 are mated, the side guide portions 54 guide the second protruding end portions 122, and the contact arm portions 55 establish contact with the second reinforcing metal fitting 151 mounted on the second housing 111. In this way, the first protruding end portion 21 of the first housing 11 is not damaged or broken during the mating process, a reliable electrical connection can be maintained between the first reinforcing metal fitting 51 and the second reinforcing metal fitting 151, and more reliable mating with the second connector 101 can be ensured.

The first reinforcing metal fitting 51 also includes a first main body portion 52 extending in the transverse direction of the first housing 11, and a pair of left and right connecting arm portions 53 connected at the base end to both ends of the first main body portion 52. The contact arm portion 55 is connected to the free end of the connecting arm portion 53, and the side guide portion 54 is connected closer to the base than to the free end of the connecting arm portion 53. Therefore, the length of the spring extends to the contact arm portion 55, and the contact arm portion 55 is much more elastically deformable. The first protruding end portion 21 also includes a mating recessed portion 22 for receiving the inserted second protruding end portion 122, and a pair of left and right inner wall side surfaces 21*j* extending in the longitudinal direction of the first housing 11 serving as the inner wall surfaces of the mating recessed portion 22. The side guide portion 54 covers at least some of the inner wall side surfaces 21*j*. Therefore, the inner wall side surfaces 21*j* are neither damaged nor broken.

The first protruding end portion 21 also includes an inner wall end surface 21*e* extending in the transverse direction of the first housing 11 and serving as an inner wall surface of the mating recessed portion 22. The first reinforcing metal fitting 51 includes a central guide portion 57 covering at least some of the inner wall end surface 21*e*. The central guide portion 57 guides the second protruding end portion 122 when the first housing 11 is mated with the second housing 111 of the second connector 101. As a result, the inner wall end surface 21*e* is neither damaged nor broken.

The side guide portion 54 is elastically displaceable downward and outward by the displacement of the connecting arm portion 53. When the bottom end portion 54*b* of the side guide portion 54 comes into contact with the supporting surface 27*a* and the inner wall side surface 21*j*, the downward and outward displacement is stopped. As a result, the side guide portion 54 can be stopped without coming into contact with the upper end of the first protruding end portion 21, and the upper end of the first protruding end portion 21 is neither damaged nor broken. The contact arm portion 55 is also displaceable downward and outward even when downward and outward displacement of the side guide portion 54 has been stopped. Because the contact arm portion 55 combines significant displaceability and strong spring action, reliable contact can be maintained with the second reinforcing metal fitting 151.

The contact arm portion 55 includes a lower curving portion 55*b* with a curving convex surface and a lower end portion 55*c*. When the lower curving portion 55*b* comes into contact with the second reinforcing metal fitting 151, the lower end portion 55*c* is displaced outward, and inserted into the contact arm portion lower end accommodating hole 28*b* formed in the first housing 11. However, because the lower end portion 55*c* is inserted into and engages the contact arm portion lower end accommodating hole 28*b*, upward displacement of the lower end portion 55*c* is prevented, upcurling of the lower curving portion 55*b* is prevented, and detachment of the contact arm portion 55 from the first housing 11 is prevented even when the first connector 1 and/or second connector 101 is moved in the direction opposite that of mating, and force is applied upward in the detachment direction from the first housing 11 to the contact arm portion 55.

While a preferred embodiment of the Present Disclosure is shown and described, it is envisioned that those skilled in the art may devise various modifications without departing from the spirit and scope of the foregoing Description and the appended Claims.

What is claimed is:

1. A connector, the connector comprising:

a connector main body, the connector main body having an end portion, the connector main body including a mating guide portion formed on the end portion of the connector main body, the mating guide portion mating with an opposing mating guide portion formed on an end portion of the opposing connector main body of an opposing connector;

terminals mounted in the connector main body; and a reinforcing metal fitting mounted to the connector main body, the reinforcing metal fitting including a main body portion, a pair of left and right connecting arm portions, a pair of left and right contact arm portions, and a pair of left and right side guide portions, the connecting arm portions being connected to opposite ends of the main body portion and extending transversely from the main body portion, the contact arm portions being connected to the connecting arm portions, the side guide portions being connected to the connecting arm portions, the side guide portions being disposed in the mating guide portion, the side guide portions guiding the opposing mating guide portion, and the contact arm portions establishing contact with an opposing reinforcing metal fitting mounted in the opposing connector main body when the connector main body is mated with the opposing connector main body.

2. The connector of claim 1, wherein the contact arm portions are connected to free ends of the connecting arm portions, and the side guide portions are connected to the connecting arm portions between the free ends and where the connecting arm portions are connected to the main body portion.

3. The connector of claim 1, wherein the mating guide portion includes a mating recessed portion configured to receive the opposing mating guide portion, the mating guide portion defining a pair of left and right inner wall side surfaces which extend in a longitudinal direction of the connector main body, the side guide portions covering at least a portion of the inner wall side surfaces.

4. The connector of claim 1, wherein the mating guide portion defines an inner wall end surface which extends in a transverse direction of the connector main body, and wherein the reinforcing metal fitting includes a central guide portion that covers at least a portion of the inner wall end surface, the central guide portion guiding the opposing mating guide portion when the connector main body is mated with the opposing connector main body of the opposing connector.

5. The connector of claim 1, wherein each contact arm portion includes a downward curving portion with a protruding curved surface and a bottom end portion, the bottom end portions are displaced outward and inserted into contact arm portion bottom end accommodating holes formed in the connector main body when the downward curving portions come into contact with the opposing reinforcing metal fitting.

6. The connector of claim 1, wherein the side guide portions are connected to the connecting arm portions between where the contact arm portions are connected to the connecting arm portions and where the connecting arm portions are connected to the main body portion.

7. The connector of claim 1, wherein the side guide portions are elastically displaceable downward and outward by deformation of the connecting arm portions, and the displacement downward and outward is stopped when bottom end portions of the side guide portions come into contact with at least one stopping portion.

8. The connector of claim 7, wherein the contact arm portions are elastically displaceable downward and outward even when downward and outward displacement of the side guide portions has been stopped.

9. A connector, the connector comprising:

a connector main body, the connector main body having an end portion, the connector main body including a mating guide portion formed on the end portion of the connector main body, the mating guide portion mating with an opposing mating guide portion formed on an end portion of the opposing connector main body of an opposing connector;

terminals mounted in the connector main body; and a reinforcing metal fitting mounted in the connector body, the reinforcing metal fitting including a main body portion, a pair of left and right connecting arm portions, a pair of left and right contact arm portions, and a pair of left and right side guide portions, the main body portion extending in a direction transverse to the connector main body, the connecting arm portions having a base end connected to ends of the main body portion, the side guide portions being disposed in the mating guide portion, the side guide portions guiding the opposing mating guide portion, and the contact arm portions establishing contact with an opposing reinforcing metal fitting mounted in the opposing connector main body when the connector main body is mated with the opposing connector main body, wherein the side guide portions are elastically displaceable downward and outward by deformation of the connecting arm portions, and the displacement downward and outward is stopped when bottom end portions of the side guide portions come into contact with at least one stopping portion.

10. The connector of claim 9, wherein the mating guide portion defines a pair of left and right inner wall side surfaces which extend in a longitudinal direction of the connector main body, the side guide portions covering at least a portion of the inner wall side surfaces.

11. The connector of claim 9, wherein the contact arm portions are elastically displaceable downward and outward even when downward and outward displacement of the side guide portions has been stopped.

12. The connector of claim 9, wherein the mating guide portion defines an inner wall end surface which extends in a transverse direction of the connector main body, and wherein the reinforcing metal fitting includes a central guide portion that covers at least a portion of the inner wall end surface, the central guide portion guiding the opposing mating guide portion when the connector main body is mated with the opposing connector main body of the opposing connector.

13. A connector, the connector comprising:

a connector main body, the connector main body having an end portion, the connector main body including a mating guide portion formed on the end portion of the connector main body, the mating guide portion mating with an opposing mating guide portion formed on an end portion of the opposing connector main body of an opposing connector, the mating guide portion includes a mating recessed portion configured to receive the opposing mating guide portion, the mating guide portion defining a pair of left and right inner wall side surfaces which extend in a longitudinal direction of the connector main body;

terminals mounted in the connector main body; and a reinforcing metal fitting mounted in the connector body, the reinforcing metal fitting including a main body portion, a pair of left and right connecting arm portions, a pair of left and right contact arm portions, and a pair of left and right side guide portions, the main body portion extending in a direction transverse to the connector main body, the connecting arm portions having a base end connected to ends of the main body portion, the side guide portions being disposed in the mating guide portion, the side guide portions covering at least a portion of the inner wall side surfaces, the side guide portions guiding the opposing mating guide portion, and the contact arm portions establishing contact with an opposing reinforcing metal fitting mounted in the opposing connector main body when the connector main body is mated with the opposing connector main body.

14. The connector of claim 13, wherein the mating guide portion defines an inner wall end surface which extends in a transverse direction of the connector main body, and wherein the reinforcing metal fitting includes a central guide portion that covers at least a portion of the inner wall end surface, the central guide portion guiding the opposing mating guide portion when the connector main body is mated with the opposing connector main body of the opposing connector.

15. A connector, the connector comprising:

a connector main body, the connector main body having an end portion, the connector main body including a mating guide portion formed on the end portion of the connector main body, the mating guide portion defining an interior mating recessed portion configured to receive an opposing mating guide portion formed on an end portion of an opposing connector main body of an opposing connector, the mating guide portion further defining an exterior surface;

terminals mounted in the connector main body; and a reinforcing metal fitting mounted to the connector main body, the reinforcing metal fitting including a main body portion, a pair of left and right connecting arm portions, a pair of left and right contact arm portions, and a pair of left and right side guide portions, the connecting arm portions being connected to opposite ends of the main body portion and extending transversely from the main body portion, the connecting arm portions being positioned against the exterior surface of the mating guide portion, the contact arm portions being connected to the connecting arm portions, the side guide portions being connected to the connecting arm portions, the side guide portions being disposed in the interior mating recessed portion.

16. The connector of claim 15, wherein the mating guide portion defines a pair of left and right inner wall side surfaces which extend in a longitudinal direction of the connector main body, the side guide portions covering at least a portion of the inner wall side surfaces.

17. The connector of claim 15, wherein the mating guide portion defines an inner wall end surface which extends in a transverse direction of the connector main body, and wherein the reinforcing metal fitting includes a central guide portion that covers at least a portion of the inner wall end surface, the central guide portion guiding the opposing mating guide portion when the connector main body is mated with the opposing connector main body of the opposing connector.

18. The connector of claim 15, wherein the side guide portions are connected to the connecting arm portions between where the contact arm portions are connected to the connecting arm portions and where the connecting arm portions are connected to the main body portion.

19. The connector of claim 15, wherein the side guide portions are elastically displaceable downward and outward by deformation of the connecting arm portions, and the displacement downward and outward is stopped when bottom end portions of the side guide portions come into contact with at least one stopping portion.

20. The connector of claim 19, wherein the contact arm portions are elastically displaceable downward and outward even when downward and outward displacement of the side guide portions has been stopped.

* * * * *